US005212719A

United States Patent [19]

Virta et al.

[11] Patent Number: 5,212,719

[45] Date of Patent: May 18, 1993

[54] METHOD AND APPARATUS FOR RADIOGRAPHY

[75] Inventors: Arto Virta, Helsinki; Timo Muller, Espoo, both of Finland

[73] Assignee: Planmed Oy, Finland

[21] Appl. No.: 792,726

[22] Filed: Nov. 15, 1991

[30] Foreign Application Priority Data

Nov. 22, 1990 [FI] Finland ..... 905779

[51] Int. Cl.[5] ..... G21K 1/00

[52] U.S. Cl. ..... 378/155; 378/146; 378/154

[58] Field of Search ..... 378/155, 154, 152, 151, 378/150, 149, 147, 146, 145, 185, 186, 7, 37

[56] References Cited

U.S. PATENT DOCUMENTS

| | | | |
|---|---|---|---|
| 2,774,885 | 12/1956 | Brown . | |
| 2,938,120 | 5/1960 | Forsyth . | |
| 3,971,946 | 7/1976 | Craig . | |
| 4,380,086 | 4/1983 | Vagi | 378/155 |
| 4,646,340 | 2/1987 | Bauer | 378/155 |
| 4,731,806 | 3/1988 | Takahata . | |
| 4,760,589 | 7/1988 | Siczek . | |
| 4,803,716 | 2/1989 | Ammann et al. | 378/155 |
| 4,901,335 | 2/1990 | Ferlic . | |
| 5,040,202 | 8/1991 | Scheid | 378/155 |

FOREIGN PATENT DOCUMENTS

| | | |
|---|---|---|
| 856752 | 8/1940 | France . |
| 2507810 | 10/1983 | France . |

*Primary Examiner*—David F. Porta
*Attorney, Agent, or Firm*—Jones & Askew

[57] ABSTRACT

A method and apparatus for radiographic techniques using an x-ray source (13). The radiographed object (M) is subjected to a beam (X) of radiation which is employed for forming a radiographic image of the object (M) onto a film (25). Between the radiographed object (M) and the film (25) is utilized a grid assembly (20) that prevents the disturbing effect of backscattered radiation or secondary radiation generated in the radiographed object on the radiographed image. The grid assembly (20) comprises a grid plate (22) having several equidistantly spaced lamellas opaque to x-rays. The x-rays can pass in the direction of the beam axis between the spaces (24) of said lamellas to the film (25). The grid plate is reciprocatingly oscillated at a varying amplitude so that the stops and changes of travel direction ($K_1 \ldots K_5$) are appropriately evenly distributed over the interlamellar spaces of the grid plate (22), thereby avoiding the imaging the grid lamellas (23) in a disturbing manner onto the film (25) or other imaging means.

14 Claims, 7 Drawing Sheets

PRIOR-ART TECHNIQUE

METHOD AND APPARATUS FOR RADIOGRAPHY

The invention relates to a method applicable to radiography, said method utilizing an x-ray source whose beam is focused onto the object to be radiographed, whereby said beam is used for producing an x-ray image of the radiographed object onto a film or similar imaging means, and in which method a grid assembly adapted between the radiographed object and the film or similar means is used, said grid assembly serving the purpose of canceling the disturbing effect caused by backscattered or secondary radiation generated in the radiographed object from the radiographed image, and further, said grid assembly comprising a grid plate having several parallel, essentially equidistantly spaced, x-ray opaque lamellas, whereby x-ray radiation can pass through the space between said lamellas in the direction of the x-ray beam to act on the film, and in which method the grid plate is set in an oscillating motion in the plane of the grid plate in a direction perpendicular to the longitudinal direction of the grid lamellas.

Furthermore, the invention concerns a radiographic apparatus, particularly for medical use, said apparatus comprising an x-ray radiation source whose beam is focused onto the object to be radiographed, said apparatus further comprising a film cassette or similar imaging device, said apparatus further comprising a grid assembly composed of a grid plate formed of a multitude of parallel and/or crossed grid lamellas of x-ray opaque material, whose plane is aligned parallel with the beam axis so as to allow the x-ray radiation to pass through their interlamellar spaces of the grid to focus on the film or similar media, and said apparatus finally comprising a transfer mechanism, with which said grid plate can be oscillated along its guides in a direction perpendicular to the longitudinal axis of the grid lamellas.

Conventional radiographic techniques use a grid placed between the x-ray beam and the film, whereby said grid is comprised of grid lamellas made of, e.g., lead, said lamellas being capable of preventing the secondary radiation generated in the radiographed object and the radiation backscattered therefrom from reaching the film. A problem of the prior art technique is that the grid lamellas tend to become imaged on the film. To counteract this phenomenon, the grid plate is conventionally arranged to be movable in a direction perpendicular to the longitudinal axis of the grid lamellas.

Known in the prior-art techniques are such movable and oscillating grid structures which are based on a grid plate moving reciprocatingly with a relatively high amplitude along a linear path. A problem of these grid structures arises from the reason that the grid velocity at the apex point of motion is zero, whereby an image of the grid tend to form on the film. Because conventional grid structures require either substantially large movements, amplitudes or total linear paths, the average velocity of the grid becomes notably high, combined with high accelerations; all of these factors causing vibration and noise problems.

Therefore, the design of prior-art grid constructions has aimed to avoid the imaging of the grid onto the film by way of utilizing rapid movements.

With respect to the level of the prior-art techniques most closely related to the present patent, exemplifying references are made to the U.S. Pat. Nos. 3,971,946, 4,646,340 and 4,731,806 as well as the F patent 8,111,622.

The above-mentioned publications disclose such a conventional structure of a grid for an x-ray apparatus in which the grid is moved in a direction perpendicular to the length of its lamellas with a relatively high amplitude of the motion, up to several tens of interlamellar spacings of the grid. For instance, U.S. Pat. No. 4,646,340 uses a cam wheel for driving the grid, said cam resting against a follower cam fixed to the grid in order to achieve a reciprocating motion. In the aforementioned U.S. Pat. No. 4,731,806, the motion of the grid is attained by means of a rotating crank mechanism that moves the grid reciprocatingly.

Conventional x-ray apparatuses known in the art, such as mammography equipment for instance, are provided with automated exposure timers. Their operation is based on radiation detectors which monitor the intensity of the radiation transmitted through the object to be radiographed, such as a breast in mammography, and switch off the beam immediately when a sufficient dose of radiation for the optimal exposure of the film has been integrated.

A problem in the use of grid structures arises therefrom that the length of the exposure cannot be determined beforehand. Thus, the grid system design must work from the assumption of the shortest possible time, whereby high velocities of the grid plates have been compulsory, moreover, combined with rapid change of direction in the oscillating motions; both of these unfortunately resulting in the drawbacks mentioned above.

When linear motion with constant velocity is used in the conventional manner, the total path of the grid becomes substantially long for long exposure times. Therefore, the grid structure requires an arrangement with sufficient free space for the grid's lateral motion. This space causes, e.g., in mammography, a drawback therein that the film cannot be placed tightly against the radiographed tissue. A further disadvantage arises from the deterioration of the grid's focusing capability when the grid is driven laterally in large-amplitude movements.

In radiographic equipment with presettable exposure timing, the velocity of the grid is adjustable in a manner that avoids most of the above-described problems. In modern radiographic apparatuses, however, the exposure time is determined by an automated exposure system thus making it impossible at the beginning of the exposure to predict the total duration of the exposure which is dependent on a multitude of different factors such as the loading capability of the x-ray tube. Hence, the conventional methods fail to achieve an optimal adjustment of the grid's motion without getting involved with the above-mentioned problems.

It is an object of the present invention to achieve novel solutions to the above-described problems.

The present invention aims to achieve a novel method and apparatus capable of overcoming mot of the aforedescribed drawbacks.

To achieve the goals of the invention, the method according to the invention is principally characterized in that the grid plate is set in a reciprocatingly oscillating motion with a varying amplitude so that the stops or changes of direction in the oscillating motion are distributed essentially evenly over the interlamellar spaces of the grid plate so as to prevent the grid lamellas from becoming imaged onto the film or similar medium in a disturbing manner.

Furthermore, the apparatus according to the invention is principally characterized in that the apparatus comprises such a drive mechanism connected to the grid plate that brings the grid plate to a reciprocatingly oscillating motion with a varying amplitude in the plane of the grid plate so that the grid lamellas are subjected to a plurality of changes of direction even at shortest exposure times used in radiographic imaging.

To achieve this, the invention is based on the idea of eliminating the image of the grid from picture formed on the film, thus avoiding its disturbing effect on the interpretation of the actual object's image, not by an uninterrupted motion of the grid, but instead, by stopping the reciprocatingly moving grid in a controlled manner even during the shortest possible exposures in so many positions between the interlamellar spaces of the grid lattice the result in a sufficiently high number of merging interlaced images to defeat the resolution capabilities of the film. This is made possible by way of driving the grid with a microscale motion in accordance with the invention, whereby said motion is characterized by a variable amplitude, and advantageously, by way of simultaneously performing in a single direction a movement with a total maximum length of about 3 times the interlamellar spacing between two adjacent lamellas.

In practice, the invention achieves the following significant benefits: The invention provides for the grid motion a total amplitude of at least one order of magnitude smaller than that possible in the prior-art techniques, in fact, maximally in the order of 3-fold the interlamellar spacing of the grid lamellas. This means that the grid structure need not be essentially wider than the film used, which facilitates placing the film laterally closer to the radiographed object than is possible in the conventional techniques. Due to the small amplitude of grid motions, the focusing capabilities are retained optimal.

By virtue of the invention, the average velocity of the grid can be essentially reduced in comparison with conventional types of cscillating grids, whereby smaller accelerations, vibrations and noises of the grid structure result, thus yielding an improved resolution of the image.

The method and apparatus according to the invention can be advantageously implemented by means of simple mechanical constructions using, e.g., a combination of a stepper motor with a recirculating ball screw controlled by a microprocessor.

The invention is next examined in greater detail with the help of a few exemplifying embodiments, whereby the illustrated details must not be understood to limit the applications of the invention, by making reference to the figures of the attached drawing, in which FIG. 1 shows diagrammatically in a front view a mammography apparatus which utilizes the method according to the present invention.

Figure 1:
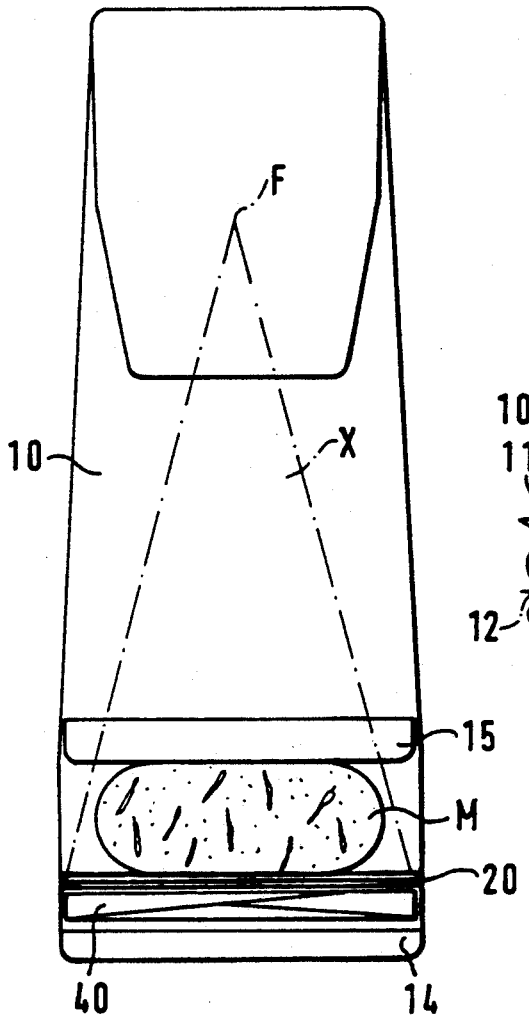
Figure 2:
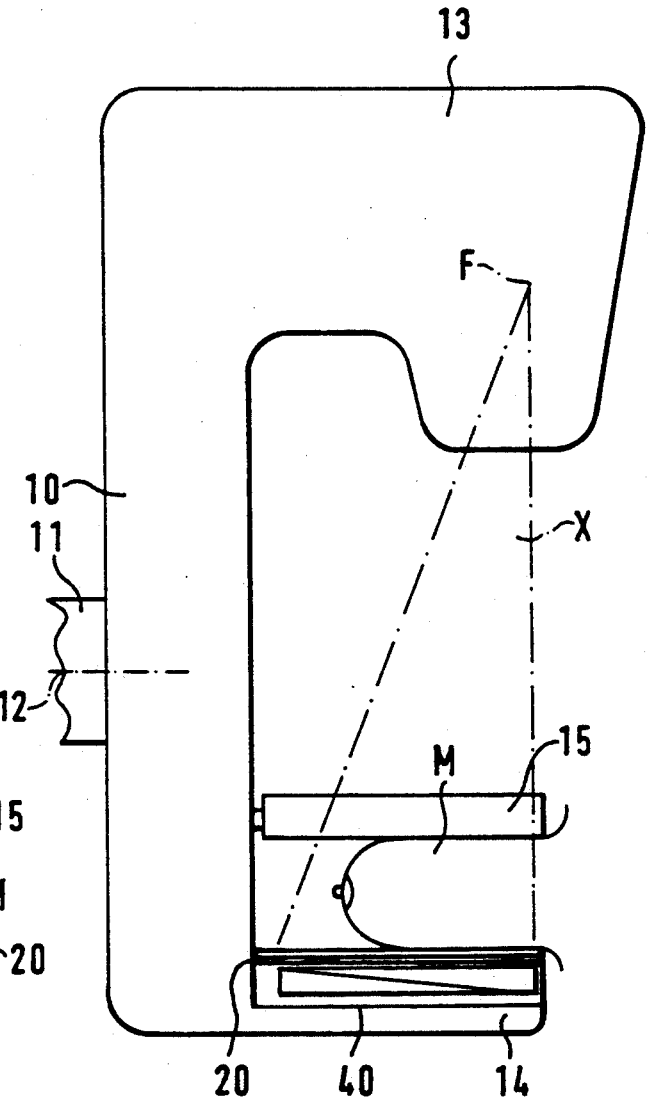
FIG. 2 shows the apparatus illustrated in FIG. 1 in a side view.
Figure 3:
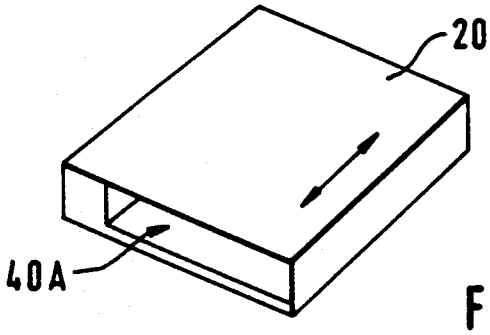
FIG. 3 shows an accessory-type grid assembly employed according to the invention with a construction permitting its installation on the film cassette plane.

FIGS. 1 . . . 6 illustrate an example of the operating environment of the invention. The mammography apparatus shown is comprised of a C-arm 10 carrying an x-ray tube head 13 and support arm 14 that carries fixed to it an x-ray film cassette 40 and a grid assembly 20 in accordance with the invention, both resting on said cassette. The grid assembly 20 contains a space 40A into which the film cassette is inserted. The C-arm 10 is mounted to the base (not shown) of the mammography apparatus by means of a support member 11, which allows rotation about the horizontal axis 12. A breast M to be radiographed in pressed with the help of the paddle-shaped upper compression plate 15 onto the breast-supporting paddle-shaped support plate of the grid assembly 20, said assembly containing a space 40A into which a film cassette 40 has been inserted. Radiography of the breast takes place by means of an x-ray beam X emitted from the focus point F of the x-ray tube head 13 and performing the exposure of the breast onto a film 25 placed in the cassette 40, while at the same time the grid plate 22 illustrated in detail in FIG. 8 is reciprocatingly oscillated in the direction of arrow T by virtue of the method and apparatus in accordance with the present invention.

Figure 4:
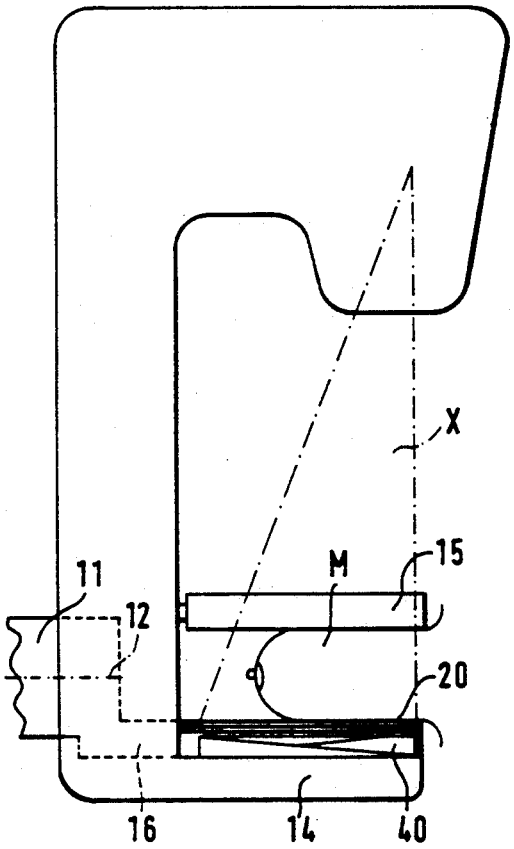
FIG. 4 shows the operation of the mammography apparatus illustrated in FIG. 2, said apparatus employing a grid assembly in accordance with the present invention, whereby said assembly is mounted so as to replace the lower compression plate of the mammography apparatus.
Figure 5:
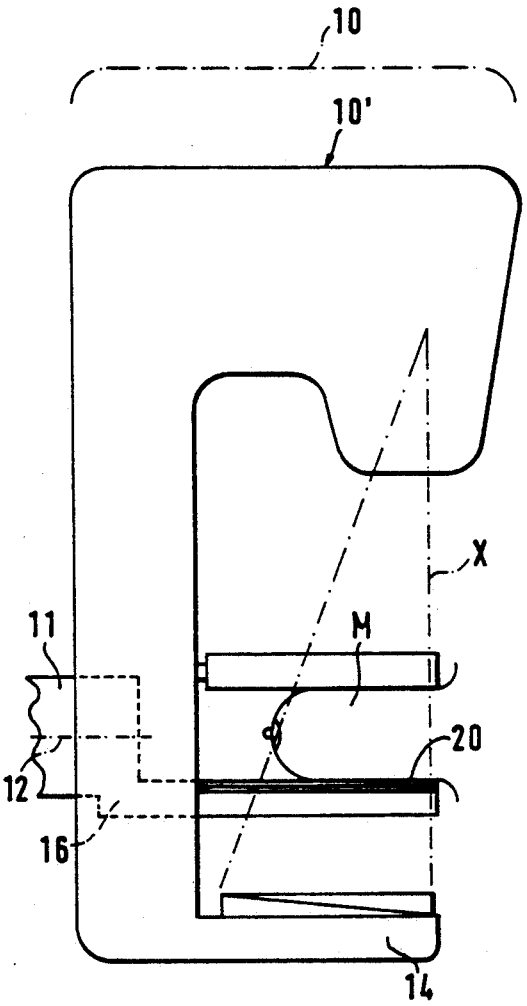
FIG. 5 shows the same arrangement as FIG. 4; in this case the mammography apparatus is adjusted to the "Load" position.
Figure 6:
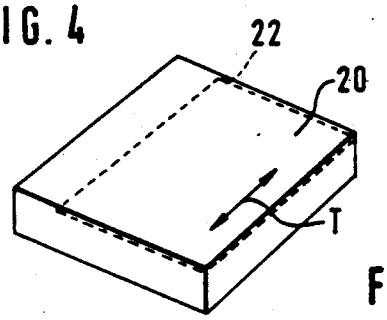
FIG. 6 shows an accessory-type grid assembly in accordance with the invention suitable for use in the apparatus illustrated in FIGS. 4 and 5.

FIGS. 4, 5 and 6 illustrate another grid assembly in accordance with the present invention for a mammography apparatus. The grid assembly 20 is shaped into a tray simultaneously acts as a lower compression plate against which an upper compression plate? 15 presses the breast M to be radiographed. The film cassette 40 is placed onto the cassette plane 14. The mounting of the film cassette 40 is separate from the grid assembly 20 so as to allow the motion of the C-arm from a position 10 to a position 10' for bringing the film cassette 40 to its operating position.

Figure 7:
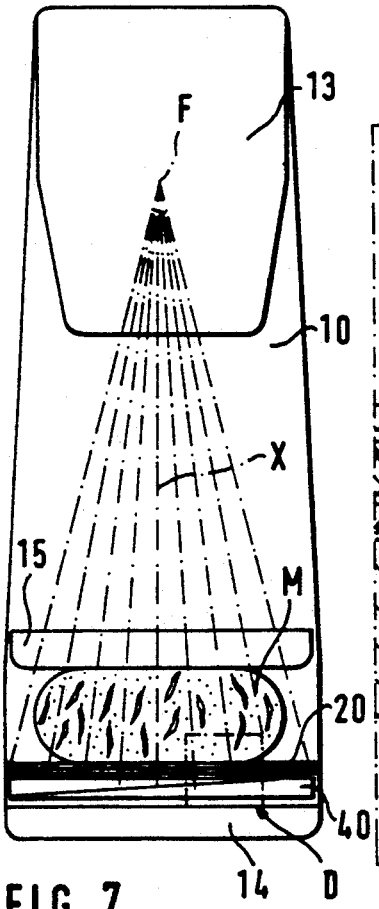
FIG. 7 shows in a front view the grid assembly in accordance with the invention adapted to a mammographic x-ray apparatus.
Figure 8:
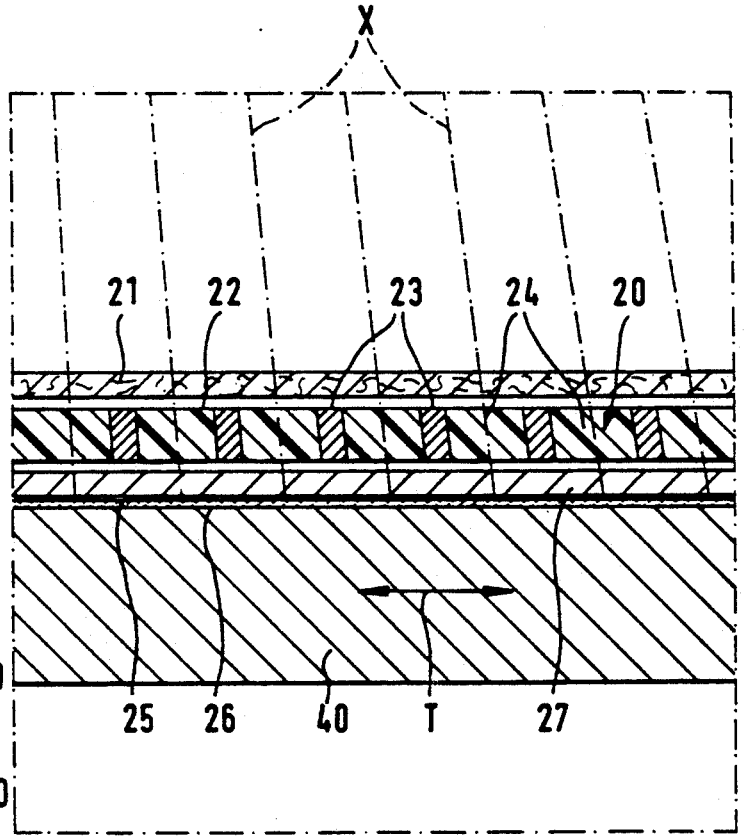
FIG. 8 shows detail D of FIG. 7 in an enlarged view.
Figure 9:
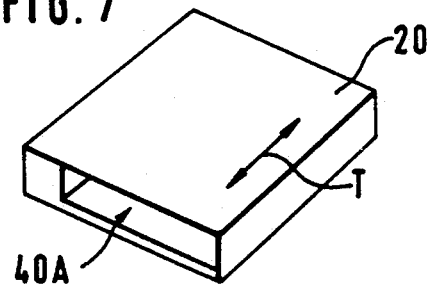
FIG. 9 shows diagrammatically in an axonometric view the grid assembly in accordance with the present invention for use in a mammography apparatus similar to that illustrated in FIGS. 7 and 8.

FIGS. 7, 8 and 9 illustrate in detail the construction and operating principle of the grid assembly in accordance with the present invention. FIG. 8, which shows detail D of FIG. 7 in an enlarged scale, illustrates the detailed structure of the grid assembly 20 in an elevated cross-sectional view. The grid assembly 20 comprises a wall 21 of said assembly's supporting plane or duct, said wall being made of an x-ray transparent material, yet having appreciable stiffness so as to be capable of supporting the radiographed breast M without undergoing any essential deformation in its shape. The wall 21 is advantageously made of a carbon-fiber reinforced laminate, which has sufficient stiffness even for very thin walls. Underneath the wall 21, which is movable in the direction T, is a grid plate 22 made of mutually parallel aligned lead lamellas 23 interspaced by x-ray transparent spacer members 24 of wood or plastic. The plane of the lamellas 23 is aligned with respect to x-ray beam X so that the lamellar grid plate 22 is transparent to x-ray radiation, while it simultaneously is capable of preventing the backscattered radiation and secondary radiation generated at the radiographed object M from reaching the x-ray film 25. Underneath the grid plate 22 is the upper wall 27 of the film cassette which contains the film 25 and underneath it, an image intensifier plate 26. The grid plates 22 are reciprocatingly oscillated according to the invention in the direction of arrow T in novel method and with a mechanism to be described later in a detailed manner.

Figure 10:
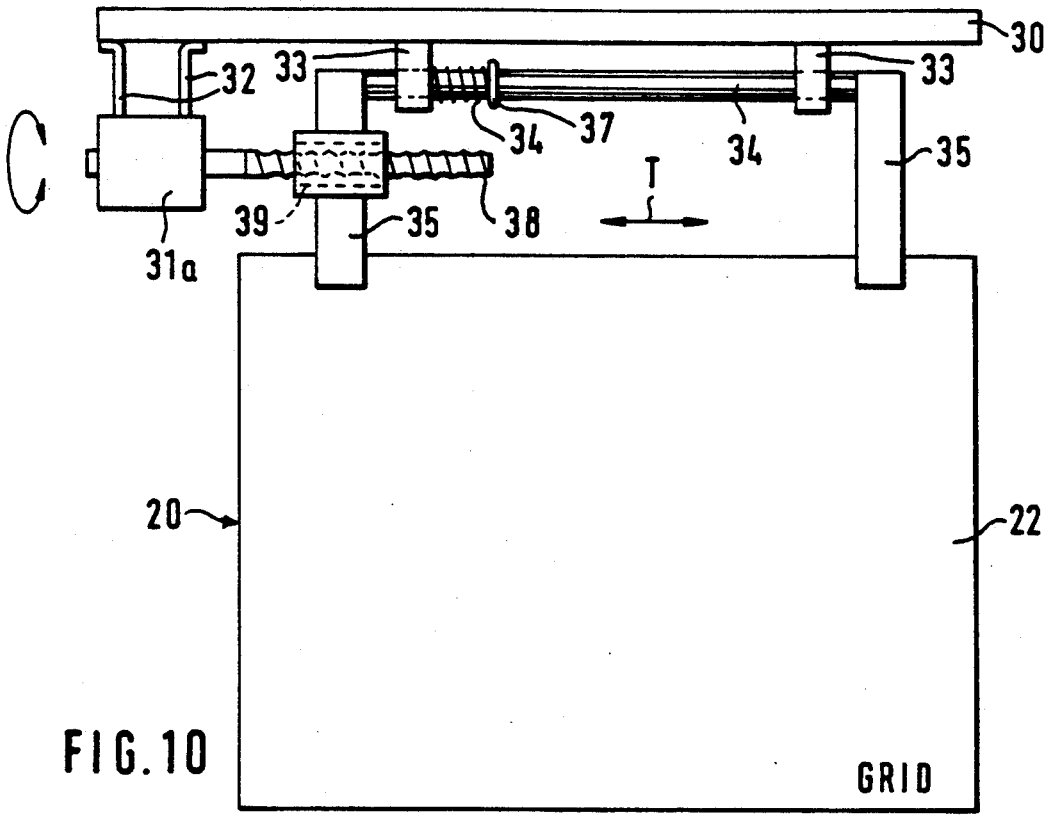
FIG. 10 shows in a detail top view the an embodiment of the oscillation mechanism of the grid assembly in accordance with the present invention.

FIG. 10 illustrates a preferred embodiment of the apparatus based on the present invention, said apparatus having the grid plate 22 reciprocating oscillated in microscale amplitudes in the direction of arrow T. The apparatus according to FIG. 10 comprises a stepper motor 31 attached by means of support members 32 to the base 30 of the apparatus. On the reversibly rotating shaft of the stepper motor 31*a* is mounted a recirculating ball screw 38 which carries a recirculating ball nut 39. The recirculating ball nut 39 is fixed to mounting lugs 35 between which a guide rail bar 34 is placed. The guide rail bar moves supported by bushing guide mounts 33 attached to the base member 30 of the grid assembly 20. Onto the guide rail bar 34, between a flange 37 and the second bushing guide mount 33, is adapted a spring 36. When the recirculating ball screw 38 mounted on the shaft of the stepper motor 31*a* rotates oscillatingly, the grid plate 22 performs oscillations with respect to the base member 30 at microscale amplitudes. The purpose of the spring 36 is to remove backlash from the movements of the grid plate 22.

The stepper motor 31*a* is driven by means of a control unit 50 (FIG. 12) via a driver circuit 51 so as to make the recirculating ball screw 38 to performs reciprocatingly oscillating rotations, thereby forcing the grid plate 22 to perform reciprocatingly oscillating movements at microscale amplitudes in a manner to be described later in a detail.

Figure 11:
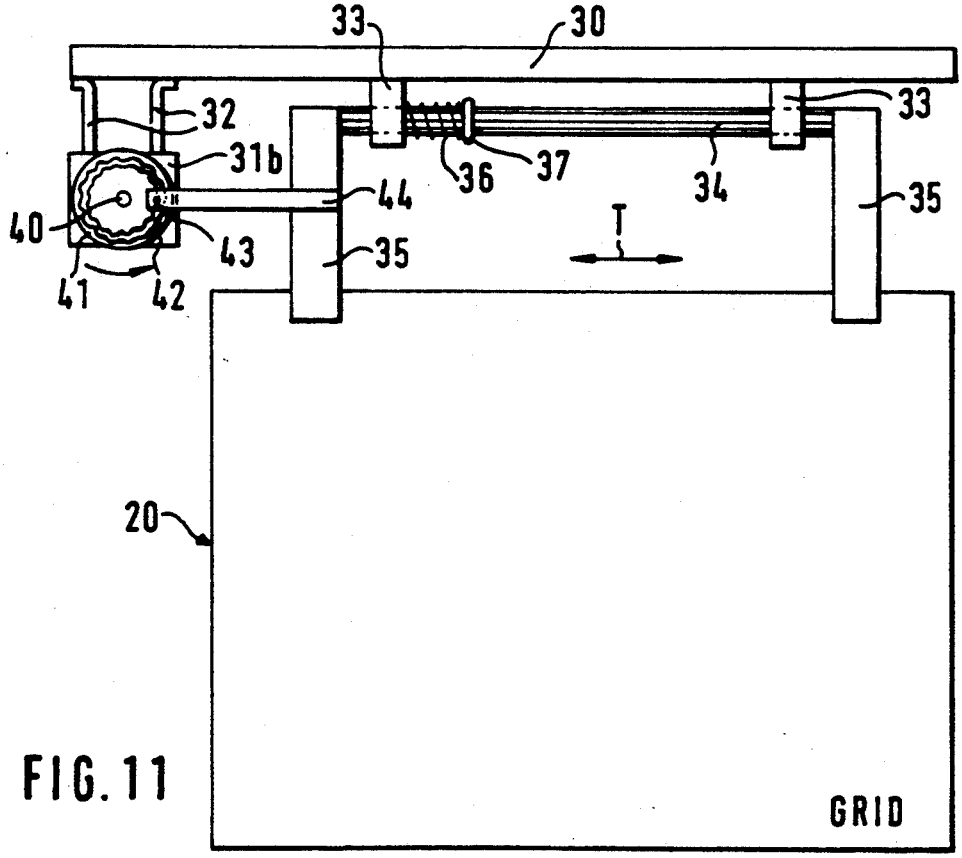
FIG. 11 shows analogously to FIG. 10 another embodiment of the oscillation mechanism of the grid assembly in accordance with the present invention.

FIG. 11 illustrates another embodiment of the invention analogous to that shown in FIG. 10 having, however, a different type of drive mechanism for the oscillatory rotating motion of the motor shaft with respect to that shown in FIG. 10. The motor 31*b* shown in FIG. 11 is run in one direction only. The shaft 40 of the motor 31*b* has an eccentrically slotted wheel 41 fixed to it, and a guide pin 43 fixed to a rod 44 is slidably adapted to the slot of said wheel. The rod 44 is attached to a mounting lug 35 of the grid plate 22. The slot 42 of the slotted wheel 40 is milled and shaped so that, e.g., a 45° rotation of the shaft drives the rod 44 through a full reciprocating cycle, whereby said cycle is repeated eight times per each full revolution of the slotted wheel 41.

Figure 12:
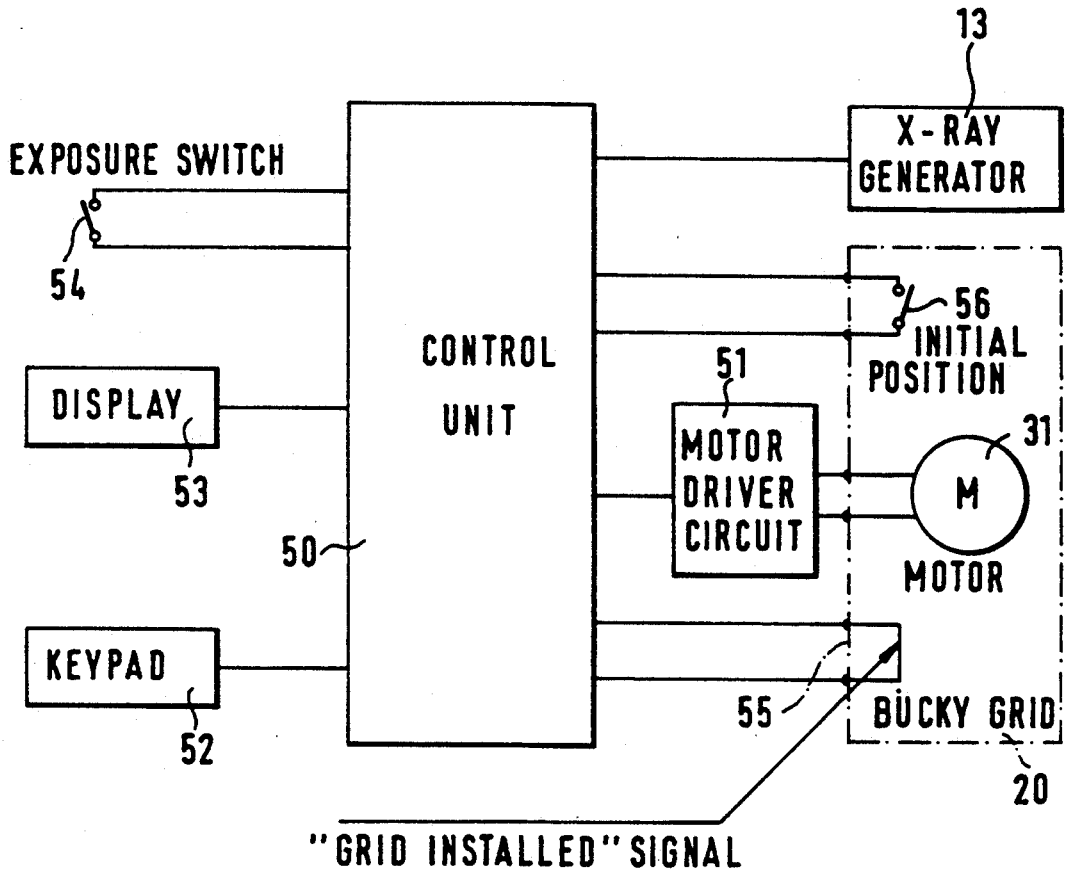
FIG. 12 shows in a diagrammatic block diagram a control system employed for controlling a grid assembly in accordance with the present invention.

FIG. 12 illustrates a control unit 50 which controls the function of the motor 31 during the operation of the entire mammographic apparatus and the grid assembly 20. Attached to the control unit 50 are a keyboard 52, a display 53 and an exposure switch 54 of the mammographic apparatus. Furthermore, the control unit 50 controls the x-ray generator 13. The control unit 50 receives a signal indicating the initial position of the grid assembly 20 from a switch 56, while the information about the proper installation of the grid assembly 20 to the control until 50 is obtained from a sensor 55. For the construction and function of the exposure logic control of the mammographic apparatus, an exemplifying embodiment can be found in the FI patent application 895610 filed by the applicant of the current application.

Figure 14:
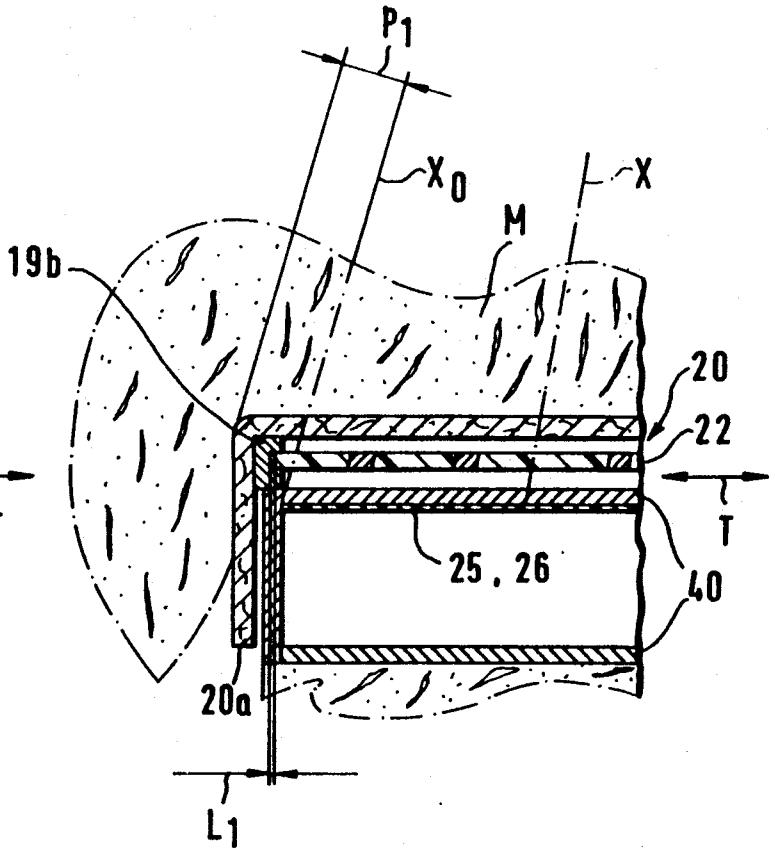
FIG. 14 shows for reference analogously to FIG. 13 the cross section of the grid assembly in accordance with the present invention.
Figure 13:
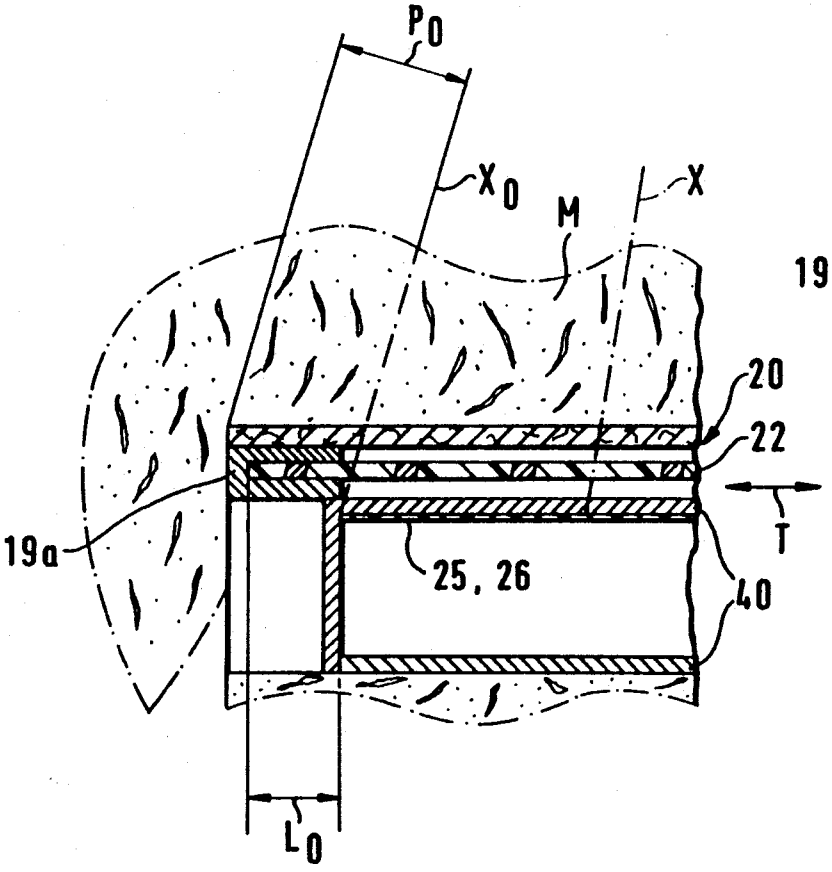
FIG. 13 shows for reference the cross section of the edge of a conventional grid assembly.

FIGS. 13 and 14 present a comparison between the travel paths of a conventional grid assembly (FIG. 13) and a grid assembly 22 (FIG. 14) according to the present invention. FIG. 13 presents the guide mechanism of a prior-art grid plate 22, said mechanism comprising a guide rail 19*a*. According to FIG. 13, the marginal areas of the radiographed object M are shadowed for an area $P_0$, because the laterally shadowed with $L_0$ of the edge of the grid 22 is in the order of approx. 10 mm, which includes the lateral motion of the grid plate 22 in the guide rail 19*a* and a sufficient overlapping to avoid the withdrawal of the grid plate 22 from the guide rail 19*a*. FIG. 14 illustrates correspondingly how according to the present invention the laterally shadowed width $L_1$ of moving edge of the grid plate 22 remains typically down to the order of approx. ±0.2 . . . 0.3 mm ($L_0 >> L_1$), whereby the radiographed object M remains shadowed by the appreciably smaller marginal area $P_1$ ($P_1 > P_0$), which corresponds to the distance from the edge of the film 25 in the cassette 40 to the outer edge 20*a* of the enclosure of the grid assembly.

Figure 15A:
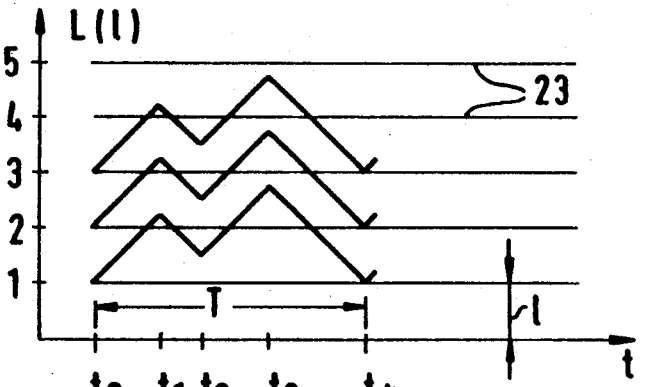
FIGS. 15A, 15B, 15C, 15D show in the travel vs. time coordinate system some advantageous paths of the oscillating motion of the grid assembly in accordance with the present invention.

FIGS. 15A . . . 15D illustrate some preferred and typical oscillation methods for the grid plate 22 of the grid assembly 20 according to the present invention, plotted in the travel vs. time coordinate system L-t. The vertical axis of the coordinate system is the travel L, divided into units equal to the interlamellar distance 1 of the grid plate lamellas 23, while the horizontal axis is time t. As illustrated in FIG. 15A, the grid plate 22 performs reciprocating oscillations in recurrent cycles T, in which the grid plate 22 moves during the time interval $t_o$–$t_1$ at a constant velocity, after which during the time interval $t_1$–$t_2$ the travel direction is reversed, and during the time interval $t_2$–$t_3$ again reversed, after which the grid plate 20 after reversal of its travel direction, during the time interval $t_3$–$t_4$, returns to its home position from where it started in the beginning of the cycle T. Consequently, according to FIG. 15A, the grid lamellas stop four times over each interlamellar space 1 at the direction change of their motion during the cycle. The stop positions are evenly distributed over the axis L of interlamellar spacings.

Figure 15B:
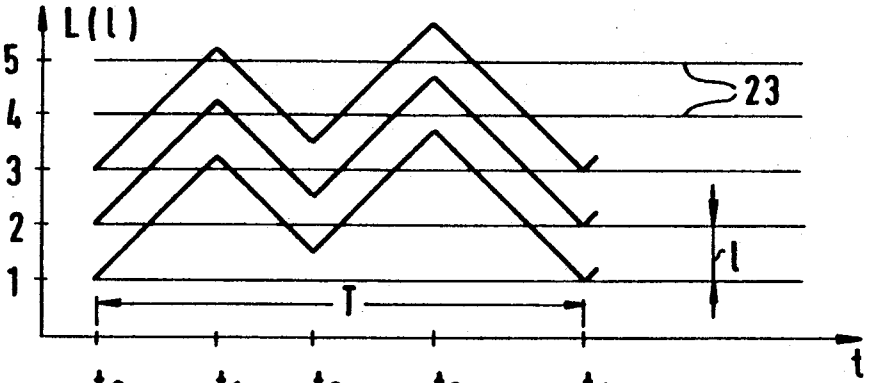
Figure 15C:
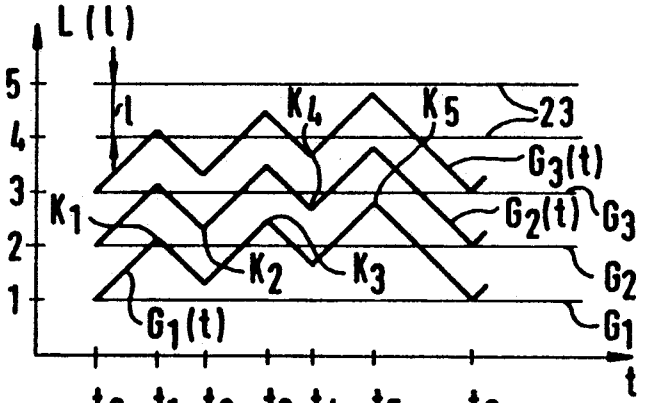
Figure 15D:
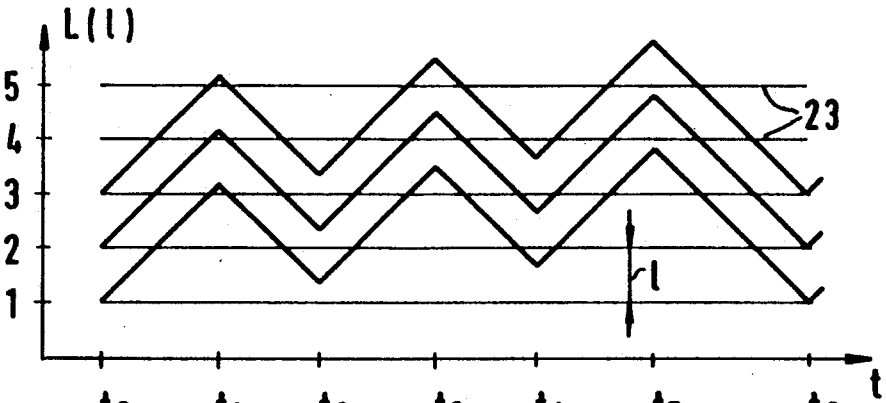

According to FIG. 15A, the motion has a maximum amplitude of 1.75 l, FIG. 15B illustrates a corresponding movement cycle T having four stop positions and a maximum amplitude 2.75 l of the motion. FIG. 15C illustrates in greater detail the travel paths $G_1(t)$, $G_2(t)$ and $G_3(t)$ of three adjacent lamellas, these paths having their stop positions at 1/6, l 2/6l, 3/6 l, 4/6 l, 5/6 l and 6/6 l (positions $K_1$, $K_2$, $K_3$, $K_4$). Consequently, the stop positions of the lamellas are evenly distributed over each interlamellar spacing, whereby the imaging of the lamellas 25 onto the film 25 is avoided. The amplitudes of movements of subsequent time intervals $t_0$, $t_1$, $t_2$, $t_3$, $t_4$, $t_5$, on the travel axis do not coincide at constant points. FIG. 15D illustrates the travel paths of three adjacent lamellas for a maximum movement amplitude of 2.83 l.

The approach described above makes it possible to implement such an oscillation method of the lamellas 23 of the grid plate 22, which method, by virtue of the sufficiently small magnitude of the variable amplitude of the oscillation motion, achieves a satisfactorily high number of direction changes of the grid plate even within the limitations of a short length of exposure. Typically, the shortest exposure times can be as small as below 0.5 s. In particularly, the stop positions of in the motion of the lamellas are critical. When these stop positions are distributed essentially evenly with a sufficient density of stop positions over the interlamellar spacings, the imaging of the grid lamellas can be avoided.

FIGS. 10 and 11 illustrates such oscillation mechanisms of the grid assembly 20 in which the motion of the grid plate 22 is altered in a cyclic and force-controlled manner so that the motion is repeated in cycles T, each of the cycles containing several changes of travel direction and stops of extremely short duration so that the total amplitude of the oscillating motion remains relatively small and typically smaller than approx. 3 l.

According to the invention, the velocity of the grid plate 22 is arranged so rapid that, during the shortest practical exposures, the grid plate 22 has sufficient time for several reciprocatingly oscillating movements. In a preferred embodiment the grid plate 22 is reciprocatingly oscillated with a constant velocity, and the direction changes of the oscillating motion are performed as abruptly and rapidly as possible. The oscillating motion is implemented in such a manner that the time consumed for direction changes is shorter by at least an order of magnitude with respect to the time of the linear portion of the oscillating motion.

The claims of the patent application are presented in the following, whereby the different details of the invention may be varied within the scope of the claims which define the invention.

We claim:

1. A Method of panoramic radiography, said method utilizing an X-ray source (13) whose beam (X) is focused onto the object (M) to be radiographed, whereby said beam (X) is used for imaging an X-ray picture of the radiographed object (M) onto an imaging means, and in which method a grid assembly (20) adapted between the radiographed object (M) and the imaging means is used, said grid assembly serving the purpose of canceling the disturbing effect caused by backscattered or secondary radiation generated in the radiographed object (M) from the radiographed image, and further, said grid assembly (20) comprising a grid plate (22) having several parallel, essentially equidistantly spaced, X-ray opaque lamellas, whereby X-ray radiation can pass through the spaces (24) between said lamellas in the direction of the X-ray beam to act on the imaging means, and in which method the grid plate (22) is set in an oscillating motion in the plane of the grid plate (22) in a direction (T) perpendicular to the longitudinal direction of the grid lamellas, characterized in that the grid plate is set in a reciprocatingly oscillating motion in a controlled manner in regular cycles (T) of travel with a varying amplitude so that the stops or changes of direction ($K_1$. . . $K_5$) in the oscillating a motion are distributed essentially evenly over the interlamellar spaces of the grid plate (22) so as to prevent the grid lamellas (23) form becoming imaged onto the imaging means in a disturbing manner.

2. A method as defined in claim 1, characterized in that the grid plate (22) is oscillated in repetitive cycles (T) of travel, so that each cycle (T) contains several stops and/or changes of travel direction.

3. A method as defined in claim 1 or 2, characterized in that the grid plate is moved in direction perpendicular to the longitudinal direction of its lamellas so that the total amplitude of the motion is maximally in the order of $33\times1$ (1=interlamellar spacing of the grid lamellas) and that, for each cycle of the motion, the grid plate (22) returns to its home position after several changes of travel direction.

4. A method as defined in claim 1, characterized in that the grid plate (22) is set in a reciprocatingly oscillating motion with an essentially constant velocity and that the changes of travel direction are performed in a time which is shorter by at least an order of magnitude with respect to the time used for the travel of the grid plate at the constant velocity.

5. A method as defined in claim 1, characterized in that the unidirectional motion of the grid plate (22), has a travel amplitude of the order of $(1 \ldots 2)\times1$ (1=interlamellar spacing of the grid lamellas) and that the duration of the unidirectional portion of the travel is in the range 0.001 . . . 0.1 s.

6. A method as defined in claim 1, characterized in that the grid plate is set in a reciprocatingly oscillating motion with such a microscale amplitude that, even for the shortest practical exposure time which generally is below 0.1 s, the grid plate can make a sufficiently high number of changes of travel direction to prevent sharp imaging of the grid on the imaging media.

7. A method as defined in claim 1, characterized in that the method is applied to mammography in which the breast (M) to radiographed is pressed between compression plates (14, 15) and the grid plate (22) of the grid assembly (20) is placed between the breast (M) and a film cassette (40).

8. A radiograph, apparatus, said apparatus comprising an X-ray radiation source (13) whose beam (X) is focused onto the object (M) to be radiographed, said apparatus further comprising an imaging device, said apparatus further comprising a grid assembly (20) composed of a grid plate (22) formed of a multitude of parallel and/or crossed grid lamellas of X-ray opaque material, whose plane is aligned parallel with the axis of the beam (X) so as to allow the X-ray radiation to pass through their interlamellar spaces (1) to focus on the imaging device, and said apparatus comprising a transfer mechanism with which said grid plate can be oscillated along its guide **(19*b*) in a direction perpendicular to the longitudinal axis of the grid lamellas, characterized in that said apparatus comprises such a drive mechanism connected to the grid plate (22) that brings the grid plate to a reciprocatingly oscillating motion in a controlled manner in regular cycles (T) of travel with a varying amplitude in the plane of the grid plate so that the grid lamellas (23)** are subjected to a plurality of changes of direction even at shortest exposure times used in radiographic imaging.

9. An apparatus as defined in claim 8, characterized in that said apparatus comprises a unidirectionally or reversibly driven motor (31*a*;31*b*) which is controlled by means of the control unit (50) of the radiographic apparatus so that the grid plate is forced to perform a reciprocatingly oscillation motion in its plane with a maximum amplitude of $(1 \ldots 3)\times 1$ where $1$=interlamellar spacing of the grid lamellas.

10. An apparatus as defined in claim 8 or 9, characterized in that the grid plate (22) is attached to mounting members (35) that are connected to the motor (31*a*,31*b*) with which the grid plate (22) is set in a reciprocatingly oscillating motion.

11. An apparatus as defined in claim 8, characterized in that said apparatus comprises a control unit (50) and a motor (31) driven by a driver circuit (51), whereby the shaft of the motor is driven to unidirectionally rotating or a reversibly oscillating rotation, and that the shaft of said motor (31) is connected to guide members (34) of the grid plate (22), said guide members permitting the motion of the grid plate (22) supported by bushing guide mounts (33) attached to the base part (30) of the grid assembly (20).

12. An apparatus as defined in claim 8, characterized in that said apparatus comprises a stepper motor (31) driven by a driver circuit (51) of a control unit (50), whereby the shaft of the motor is driven to a reversibly oscillating rotation, and that the shaft (38) of said stepper motor is connected to a guide assembly of the grid plate (22).

13. An apparatus as defined in claim 12, characterized in that said stepper motor (31) has attached to its shaft a recirculating ball screw (38) whose recirculating ball nut (39) is connected to a guide assembly (33,34,35,36) of the oscillating motion of the grid plate (FIG. 10).

14. An apparatus as defined in claim 8, characterized in that said apparatus comprises a control unit (50) and a motor (31*b*) connected to a driver circuit (51) of said motor, said motor carrying on its shaft (40) a slotted eccentric wheel (41), whose slot (42) is connected to a cranking mechanism (43, 44) that forces said grid plate (22) to an oscillating motion, and that said slot (42) of the said slotted eccentric wheel (41) is shaped so as to force the grid plate (22) to perform several oscillations with microscale amplitudes for each revolution of said slotted eccentric wheel (41).

* * * * *